US006364118B1

(12) United States Patent
Anderle et al.

(10) Patent No.: US 6,364,118 B1
(45) Date of Patent: Apr. 2, 2002

(54) SIEVE INSERT FOR A CYLINDER SIEVE MACHINE

(75) Inventors: Helmuth Anderle, Eislingen; Joachim Heer, Wäschenbeuren; Wolfgang Weiss, Ebersback-Bünzwangen, all of (DE)

(73) Assignee: Allgaier Werke GmbH, Uhingen (DE)

( * ) Notice: Subject to any disclaimer, the term of this patent is extended or adjusted under 35 U.S.C. 154(b) by 0 days.

(21) Appl. No.: 09/625,450

(22) Filed: Jul. 26, 2000

(30) Foreign Application Priority Data

Aug. 18, 1999 (EP) ..... 99116254

(51) Int. Cl.[7] ..... B07B 1/54

(52) U.S. Cl. ..... 209/382; 209/381; 209/379; 209/405; 209/408

(58) Field of Search ..... 209/382, 381, 209/379, 405, 408

(56) References Cited

U.S. PATENT DOCUMENTS

| | | | | | |
|---|---|---|---|---|---|
| 1,562,311 | A | * | 11/1925 | Dimm | 209/382 |
| 2,332,780 | A | * | 10/1943 | Cecka | 209/382 |
| 2,455,383 | A | * | 12/1948 | Pickard | 209/382 |
| 2,497,902 | A | * | 2/1950 | Moyer | 209/382 |
| 2,676,706 | A | | 4/1954 | Temple | 209/315 |
| 3,412,860 | A | * | 11/1968 | Bingham et al. | 209/382 |
| 3,565,251 | A | * | 2/1971 | Pennington | 209/323 |
| 3,899,417 | A | * | 8/1975 | Morris | 209/243 |
| 5,051,171 | A | * | 9/1991 | Hukki | 209/323 |
| 5,165,550 | A | | 11/1992 | Pierson et al. | |
| 5,538,139 | A | * | 7/1996 | Keller | 209/382 |
| 5,851,393 | A | * | 12/1998 | Carr et al. | 210/489 |
| 6,095,339 | A | * | 8/2000 | Filip | 209/382 |

FOREIGN PATENT DOCUMENTS

| | | | |
|---|---|---|---|
| DE | 297 08 307 U1 | 8/1997 | B07B/1/50 |
| EP | 0 536 803 A1 | 1/1989 | B07B/1/54 |

* cited by examiner

*Primary Examiner*—Donald P. Walsh
*Assistant Examiner*—Daniel K Schlak
(74) *Attorney, Agent, or Firm*—Randall J. Knuth

(57) ABSTRACT

A sieve insert for a cylinder sieve machine, and especially for a tumbling sieve machine. A sieve insert is provided with the features of a level sieve onto which the material to be sieved is charged, a rebound bottom substantially parallel and arranged at an interval to the sieve and carries a plurality of rebound bodies, a sieve frame for carrying the sieve, and a carrier frame carrying the rebound bottom and the sieve frame. The sieve insert is subdivided into a series of sieve segments, in which sieve frame supports the sieve segments along their contours.

10 Claims, 2 Drawing Sheets

SIEVE INSERT FOR A CYLINDER SIEVE MACHINE

BACKGROUND OF THE INVENTION

1. Field of the Invention

The invention is relative to a cylinder sieve machine, also known as a cylinder machine, cylinder mold machine, or board machine, in particular to a tumbling sieve machine. The invention concerns the sieve insert of such a machine.

2. Description of the Related Art

Such machines are known from a great number of publications. The machine comprises the following components: A level sieve that is generally round, consists of a fabric or woven cloth that comprises meshes. The machine also comprises a rebound bottom, also known as an impact bottom or baffle bottom. This rebound bottom is also level and circular and consists of a perforated sheet. The rebound bottom is arranged a certain interval from and parallel to the sieve. The sieve and the rebound bottom form two separate units.

Rebound bodies are arranged in an intermediate area between the sieve and the rebound bottom. They usually consist of rubber balls.

When the machine is in operation the material to be sieved is charged from above onto the sieve. The rebound bodies execute a knocking and wiping movement due to the motion of the machine and strike from below against the sieve. Particles of the material to be sieved that are stuck in the sieve meshes are loosened thereby so that the sieve is subjected to a constant cleaning.

The cleaning of the sieve is decisive for the degree of effectiveness of the entire sieving process. Numerous attempts have been made to improve the cleaning; nevertheless, improvement is still required.

SUMMARY OF THE INVENTION

The invention is based on the problem of designing a sieve insert for a machine of the specified type in such a manner that the cleaning is improved in comparison to known sieve inserts.

In the case of the known sieve inserts a chaotic displacement, creeping, or migration of the rebound bodies takes place in the intermediate area between the sieve and the rebound bottom. The rebound bodies execute not only the cited up and down movement but also other partial movements, e.g., creeping or migratory movements around the machine axis or movements transversely to it. The inventors recognized that it is favorable for the cleaning process to suppress these creeping movements. The optimum is a movement of the rebound bodies that is substantially up and down with relatively slight creepings in other directions.

The solution consists according to the invention in that the sieve is subdivided into sieve segments and that the sieve frame supports the sieve segments along their contours or edges. This achieves the goal that the support brings in that the rebound bodies remain in the area of that sieve segment in which they are located.

The subdivision of the sieve into a plurality of sieve segments has yet another advantage; if a sieve segment is damaged during the course of operation, only this one sieve need be replaced instead of the entire sieve, as previously accomplished. This is on the one hand more cost-effective and on the other hand it requires a lesser assembly expense. The storage of the sieve segments is less expensive, so that less capital is tied up. In addition, the manipulation becomes much easier, which is to be explained further below.

A very important advantage is constituted by the fact that when the entire sieve surface consists of a single sieve a certain sagging of the sieve will develop, at least in the passage of time. However, each sag represents a non-uniform wear of the sieve, viewed over the sieve surface. If, instead of the above, the sieve surface is subdivided into a plurality of sieve segments, accordingly smaller surfaces are involved. The sag is sharply reduced, if even still present at all, and the wear is largely uniform over the entire surface of the sieve segment.

The basic cited concept of the invention can be further developed as follows; instead of subdividing only the sieve and the frame, complete, autarkic sieve segments can be created, each of which comprises a sieve segment, a partial rebound bottom as well as a partial sieve frame. Moreover, such a construction has the advantage of being easier to manipulate and maintain.

It is also possible to select sieve segments that differ as regards their sieve qualities. Of course, each sieve segment must be associated with its own outlet for the material that passed through it.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
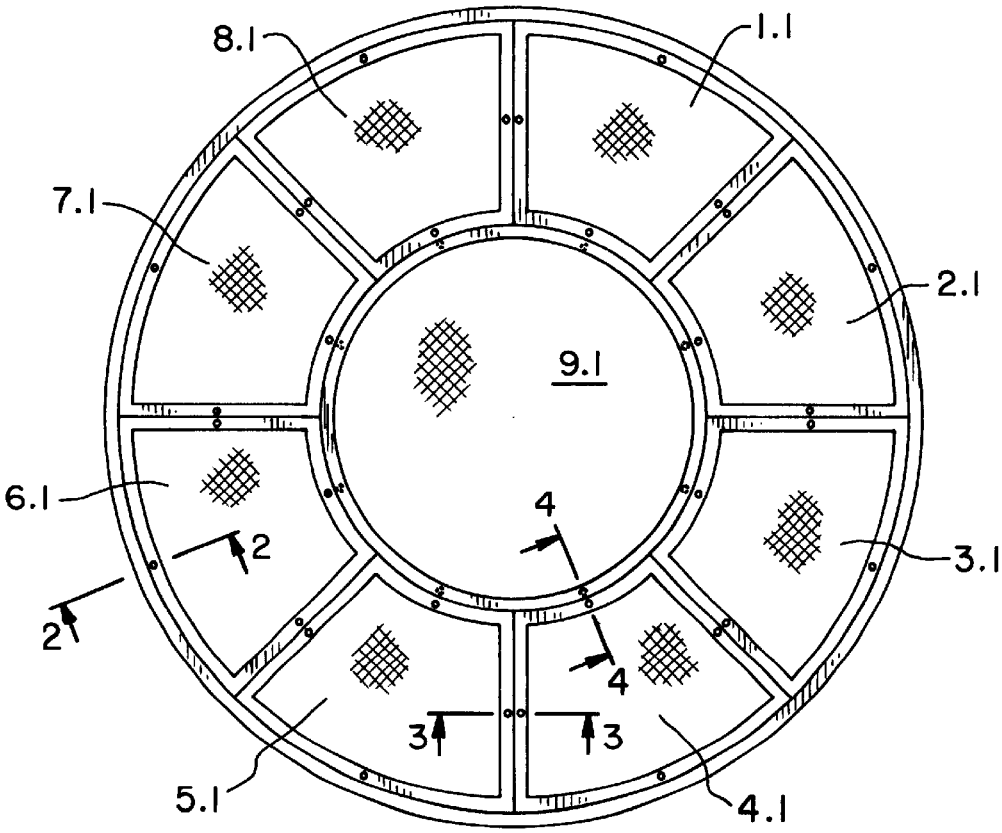
FIG. 1 shows a segmented sieve insert in accordance with the invention in a top view.

The inventive sieve insert shown in FIG. 1 has a particularly advantageous sieve insert configuration. The sieve is segmented into, for example, eight segments arranged in a ring, namely, partial segments 1.1–8.1 and furthermore into a ninth partial segment 9.1 that is circular in shape. The partial segments consist of a sieve fabric, that is, of a structure consisting of weft threads and warp threads. Other types of sieve structures are also possible, e.g., random fiber structure mat, perforated sheets or slotted sheets.

The sieve frame has a contour, viewed from the top, corresponding to partial segments 1.1 to 9.1. The sieve frame is designated in a general manner here with reference numeral 10.

Figure 2:
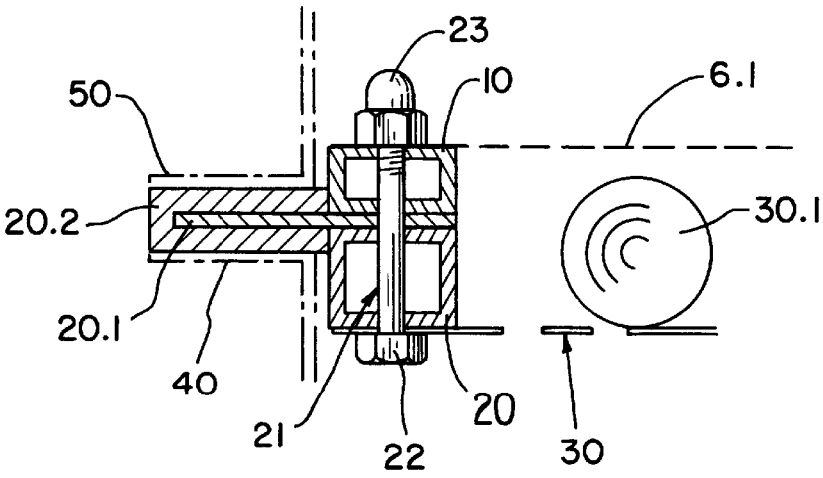
FIG. 2 shows an enlarged view of a section from the subject matter of FIG. 1 viewed in direction 2—2.
Figure 3:
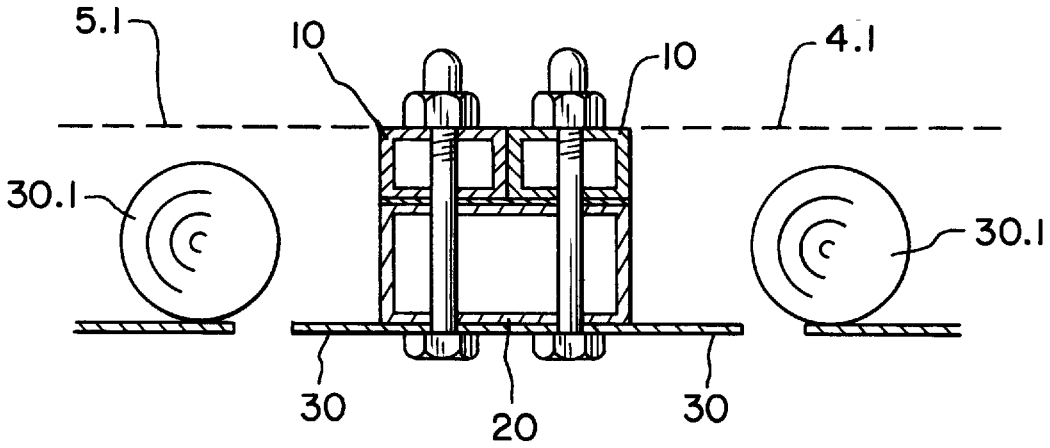
FIG. 3 is another sectional view of the subject matter of FIG. 1 viewed in direction 3—3.

FIG. 2 shows sieve frame segment 10 running in the circumferential direction. FIG. 3 shows two sieve frame segments running in radial direction. FIG. 2 indicates in dotted lines upper cylinder 50 and lower cylinder 40. Holding flange 20.1, forming a component of carrier frame 20, can be recognized. Holding flange 20.1 is surrounded on both sides by seal 20.2 in a sandwich-like manner for sealing against the cylinders.

The sieve segments are carried by the sieve frame or by sieve frame segments. The sieve frame or its segments as well as rebound bottom 30 are carried by the carrier frame. See carrier frame 20 in FIG. 2 that runs circumferentially just as sieve frame segment 10. See also carrier frame 20 in FIG. 3 running radially just as the sieve frame segments shown there. As a result of this construction, comprising sieve frame segments 10 and carrier frame 20, the entire area between sieve segments 1.1 to 9.1 on the one hand and rebound bottom 30 on the other hand is subdivided into chambers. In the area of sieve segments 1.1 to 8.1 these chambers have the approximate shape of a piece of cake in which the tip has been removed. The central chamber has a cylindrical shape. Knocking balls 30.1 consisting of rubber are introduced into the individual chambers with a certain number of balls per chamber. This has the following effect: A creeping of knocking balls 30.1 over and past the chambers is impossible. Thus, knocking balls 30.1 remain in the chamber associated with them. Tests have shown that the knocking cleaning achieved therewith is very efficient and, in particular, very uniform. The surface of the particular sieve segment is cleaned therewith very efficiently and at all points by the knocking and wiping movement of knocking balls 30.1. This has further, quite significant advantages: The load on the individual sieve segment is uniform. This avoids an extremely high local wear. The service life is greater than in the case of non-segmented sieves like those known in the state of the art.

Moreover, the uniform cleaning significantly increases the throughput. Tests have shown increases of throughput on the order of 25%.

Rebound bottom 30 is a circular perforated sheet in the present instance. However, it could also be segmented in the same manner as or in a manner similar to that of the sieve segments.

The type of fixing shown in the sectional views is also particularly interesting. They show bolt screws 21 with screw head 22 and cap nut 23. Screws 21 are run from below through carrier frame 20 and through associated sieve frame segment 10 and screwed to the cap nut.

This type of fixing permits an easy replacement of sieve segments as well as of knocking balls. If one of the sieve segments is damaged, the following procedure is followed: In the case of a tumbling sieve machine comprising, e.g., several sieve planes or s. decks, all cylinders, aside from the base cylinder, and all sieve planes are moved up and apart from each other. Then cap nuts 23 are loosened in the particular sieve segment and the particular sieve segment is slightly raised up and then laterally removed. Usually, only a single person is required removed. Precautions are taken thereby to prevent bolt screws 21 from falling down.

Figure 4:
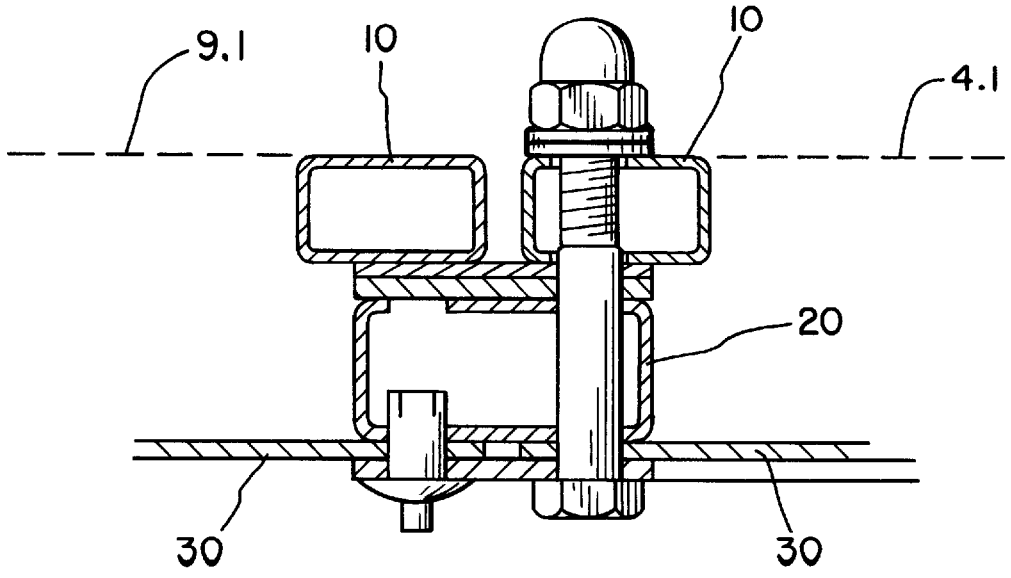
FIG. 4 shows a sectional view of the subject matter of FIG. 1 viewed in direction 4—4.

As is furthermore apparent from the sectional views according to FIGS. 2 to 4 any welding is avoided when a connection is established between the sieve frame segments, the rebound bottom and the carrier frame. This avoids a warping or distortion of the components involved.

Rebound bottom 30 is manufactured in the present instance from a single circular disk, as explained above. However, it could also be segmented like the sieve segments.

The sieve segments could also have another form than the one shown here. For example, they could consist of a plurality of hexagons.

Another type of cleaning the sieve segments could also be provided in addition to or instead of the knocking ball cleaning. Thus, it could be conceivable to clean circular, central sieve segments 9.1 with an ultrasonic device.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A sieve insert for a cylinder sieve machine, said sieve insert comprising:

a sieve onto which material to be sieved is charged;

a rebound bottom that is substantially parallel and arranged at an interval to said sieve and carries a plurality of rebound bodies;

a sieve frame carrying the sieve;

a carrier frame carrying the rebound bottom and the sieve frame;

said sieve subdivided into a series of removable, independent sieve segments and at least one segment containing a rebound body.

2. The sieve insert according to claim 1, in which the interval between the sieve segments and the rebound bottom is subdivided by separating walls into a plurality of chambers.

3. The sieve insert according to claim 2, in which separating walls are formed by segments of the sieve frame and of the carrier frame.

4. The sieve insert of claim 3, in which said sieve segments comprise a crown of outer sieve segments that form a ring and comprise a central ring segment surrounded by said outer sieve segments.

5. The sieve insert of claim 2, in which said sieve segments comprise a crown of outer sieve segments that form a ring and comprise a central ring segment surrounded by said outer sieve segments.

6. The sieve insert of claim 1, in which said sieve segments comprise a crown of outer sieve segments that form a ring in common and comprise a central ring segment surrounded by said outer sieve segments.

7. A cylinder sieve machine comprising:

a sieve onto which material to be sieved is charged;

a rebound bottom that is substantially parallel and arranged at an interval to said sieve and carries a plurality of rebound bodies;

a sieve frame carrying the sieve;

a carrier frame carrying the rebound bottom and the sieve frame; and said sieve subdivided into a series of removable, independent sieve segments and at least one segment containing a rebound body.

8. The cylinder sieve machine of claim 7, in which the interval between the sieve segments and the rebound bottom is subdivided by separating walls into a plurality of chambers.

9. The cylinder sieve machine of claim 8, in which separating walls are formed by segments of the sieve frame and of the carrier frame.

10. The cylinder sieve machine of claim 7, in which said sieve segments comprise a crown of outer sieve segments that form a ring in common and comprise a central ring segment surrounded by said outer sieve segments.

* * * * *